US007178936B2

(12) United States Patent
Lai

(10) Patent No.: US 7,178,936 B2
(45) Date of Patent: Feb. 20, 2007

(54) MAGNETIC CLOSURE AND ILLUMINATION MEANS AND CARRYING BAGS INCORPORATING SAME

(76) Inventor: Allen Wai Lun Lai, Block D, 1/F, Phase 2, Superluck Ind Centre, 57 Sha Tsui Road, Tsuen Wan, New Territories, Hong Kong SAR (HK)

( * ) Notice: Subject to any disclaimer, the term of this patent is extended or adjusted under 35 U.S.C. 154(b) by 47 days.

(21) Appl. No.: 10/887,871

(22) Filed: Jul. 12, 2004

(65) Prior Publication Data

US 2006/0007685 A1 Jan. 12, 2006

(51) Int. Cl.
*F21V 33/00* (2006.01)
*A45C 15/06* (2006.01)

(52) U.S. Cl. ..... 362/155; 362/156

(58) Field of Classification Search ..... 362/154–156
See application file for complete search history.

(56) References Cited

U.S. PATENT DOCUMENTS

| | | | | |
|---|---|---|---|---|
| 3,239,658 | A * | 3/1966 | Castaldo | 362/155 |
| 3,800,134 | A * | 3/1974 | Castaldo | 362/155 |
| 4,912,611 | A | 3/1990 | Lyle | |
| 4,972,304 | A * | 11/1990 | Ylla | 362/156 |
| 5,424,926 | A * | 6/1995 | Myers | 362/156 |
| 5,444,605 | A | 8/1995 | Rivera | |
| 5,975,713 | A | 11/1999 | Brothers | |
| 6,120,162 | A | 9/2000 | Guerrieri | |
| 6,378,174 | B1 | 4/2002 | Wong | |
| 6,508,568 | B1 * | 1/2003 | Blue-Recio | 362/156 |
| 6,582,093 | B1 * | 6/2003 | Branaugh et al. | 362/156 |
| 6,848,807 | B2 * | 2/2005 | Guerrieri | 362/155 |
| 6,848,808 | B2 * | 2/2005 | Guerrieri | 362/156 |

FOREIGN PATENT DOCUMENTS

| | | |
|---|---|---|
| DE | 4323308 A | 1/1995 |
| GB | 2082898 A | 3/1982 |

* cited by examiner

*Primary Examiner*—John Anthony Ward
*Assistant Examiner*—David Makiya
(74) *Attorney, Agent, or Firm*—Buchanan Ingersoll & Rooney PC

(57) ABSTRACT

A magnetic closure device having an illumination mechanism. The device includes a first detachable closure part that has the illumination mechanism, an electronic circuit, an actuator for operation of the illumination mechanism and the electronic circuit, and a first magnetic fastener with a first approaching surface. The device also includes a second detachable closure part that has a second magnetic fastener, wherein the second magnetic fastener includes a second approaching surface that is capable of forming a magnetically engaged configuration with the first approaching surface. The actuator is disposed adjacent to the first magnetic fastener and within the footprint or projection of the second approaching surface, and is actuated by the separation between the first and second approaching surfaces.

21 Claims, 11 Drawing Sheets

MAGNETIC CLOSURE AND ILLUMINATION MEANS AND CARRYING BAGS INCORPORATING SAME

FIELD OF THE INVENTION

This invention relates to magnetic closure means and carrying bags incorporating same. More particularly, this invention relates to magnetic closure and illumination means and re-closable carrying bags incorporating same.

BACKGROUND OF THE INVENTION

Carrying bags incorporating closure and illumination means or devices are known. For example, re-closable carrying bags have been including illumination means to light up the interior of a carrying bag to provide useful facilities to a user, for example, for searching items inside the carrying bag when in a dark environment.

U.S. Pat. No. 4,912,611 describes a handbag with an actuator which closes the contact of a control switch and turn on a light source when the handbag or purse is opened.

U.S. Pat. No. 5,444,605 describes a purse with an illumination device and a manual switch to turn on and off a light bulb inside the carrying bag.

U.S. Pat. No. 6,120,162 describes an automatic magnetic actuation system for inner illumination of a container in which an illumination means is turned on by magnetic induction when a closure flap of the handbag is moved away from a switching device.

Carrying bags equipped with means for automatic actuation of an inner illumination means when the carrying bags are opened provide security alert to a user, especially in a crowded or a dark environment when the handbag can be more easily and adversely tampered.

However, known closure and illumination means for use in carrying bags are not satisfactory. For example, the illumination means of the handbag described in U.S. Pat. No. 6,120,162 require a relatively complicated circuitry with wirings distributed inside the carrying bag and with the closure parts separately mounted from the illumination switching device. Hence, it would be highly desirable if there can be provided improved closure and illumination means and carrying means incorporating same so that the carrying bags can be easily opened and closed and, at the same time, when the carrying bag is inadvertently or adversely opened, the light will be automatically lit to alert the owner. Of course, the actuated light can also help the bag owner when searching for items inside the bag.

In this specification, the term "carrying bags" refers generally to portable containers including, but not limited to, containers with flexible closure means such as handbags or purses and containers with semi-rigid or substantially rigid closure parts such as suitcases, briefcases, make-up case, or pilot cases.

OBJECT OF THE INVENTION

Accordingly, it is an object of the present invention to provide improved closure and illumination means and carrying bags incorporating same. More specifically, although of course not solely limited thereto, it is also an object of the present invention to provide magnetic closure with inner illumination means for use in carrying bags and carrying bags incorporating the same so that the carrying bags can be more conveniently closed without much effort by the owner, and at the same time, when opened, the interior of the carrying bag will be lit so as to assist the owner as well as, or, alternatively, providing the appropriate alert. At a minimum, it is an object of the present invention to provide the public with a useful choice of magnetic closure means and carrying bags incorporating same.

SUMMARY OF THE INVENTION

Broadly speaking, the present invention has described a magnetic closure means including first and second detachable closure parts which respectively comprise first and second magnetic fasteners opposite, said first and second magnetic fasteners including means for guiding and aligning the closure of said detachable closure means substantially along a pre-determined path, said first and second detachable closure parts comprise mechanical actuation means adapted for turning on an illumination means when the separation between said first and second detachable closure parts exceeds a pre-determined threshold.

Preferably, said mechanical actuation means comprises co-operative actuation means for co-operatively actuating said illumination means when said first and second closure parts are separated beyond a prescribed separation.

According to a preferred embodiment of the present invention, there is provided a magnetic closure and illumination means comprising said co-operative actuation means including a spring urged switching device which is pressed against spring urge to turn off said illumination means when said first and second detachable closure parts are in the magnetically engaged configuration, said switching device being released by spring urge to turn on said illumination means when said first and second detachable closure parts are separated for a prescribed separation.

Preferably, one of said first and second detachable closure parts including a rigid main housing, wherein one of said magnetic fasteners, a battery compartment and an electronic circuit for controlling said illumination means being housed on said main housing, the luminescent portion of said illumination means protruding from said main housing.

Preferably, said illumination means including an LED.

Preferably, said first and second detachable closure parts including means for mounting on to corresponding closure parts of a carrying bag.

Preferably, said first and second detachable closure parts being engagable and disengagable along said pre-determined path, said illumination means including an LED with a substantially cylindrical body, the axis of said cylindrical body being substantially orthogonal to said pre-determined path.

Preferably, said first and second detachable magnetic fasteners including approaching surfaces which are in close proximity when said magnetic closure means being in the magnetically engaged closed configuration, said approaching surfaces co-operate to cause the turning on and off of said illumination means.

Preferably, said switching device including a spring urged push-button for turning on and off said illumination means, said push-button protrudes from one of said approaching surfaces and extending towards another approaching surface, said push button being pushed by said another to retract towards said one of said approaching surface to turn off said illumination means when said first and second closure parts come into closing engagement.

Preferably, said first and second magnetic fasteners being of compatible magnetic attractive properties.

Broadly speaking, this invention has described a carrying bag or portable container with magnetic closure and illumination means as described herein.

BRIEF DESCRIPTION OF THE DRAWINGS

Preferred embodiments of the present invention will be explained in further detail below by way of examples and with reference to the accompanying drawings, in which.

DETAILED DESCRIPTION OF THE PREFERRED EMBODIMENTS

Figure 12:
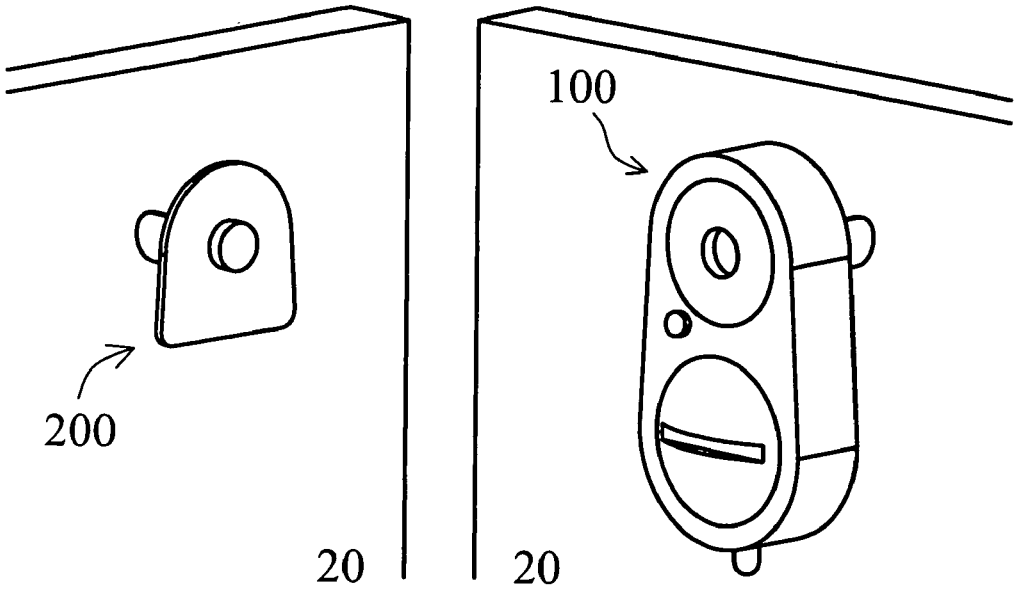
FIG. 12 illustrates the attachment of the first and second detachable closure parts of the magnetic closure means of FIG. 1 to the corresponding re-closable surfaces of a container.
Figure 13:
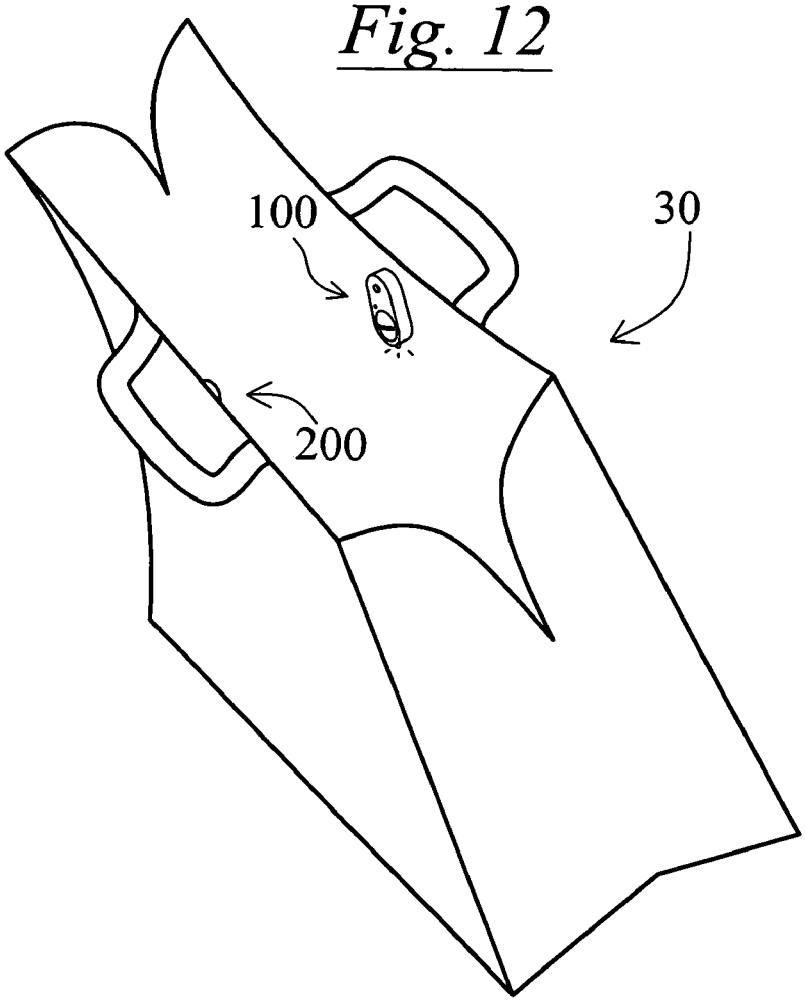
FIG. 13 is an example showing the application of the magnetic closure means of the present invention to a hand-carrying bag as a convenient example.
Figure 14:
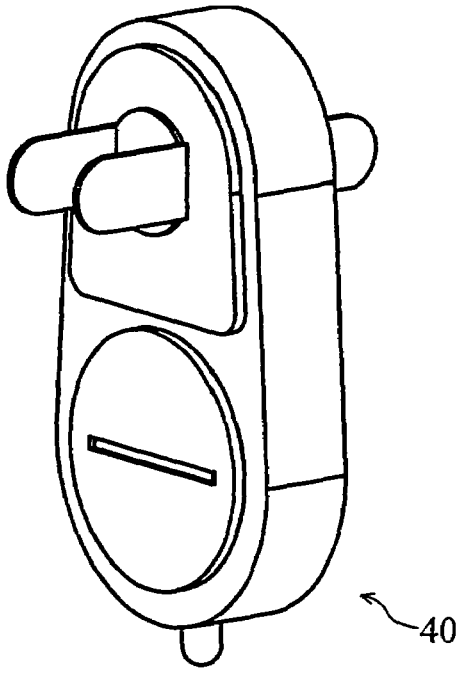
FIG. 14 is a perspective view of a magnetic closure and illumination means of a second preferred embodiment of this invention.
Figure 15:
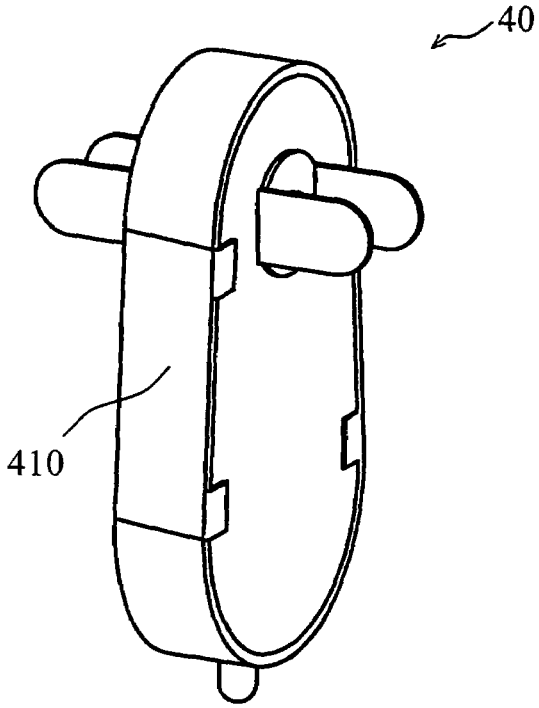
FIG. 15 is a perspective view of the magnetic closure and illumination means of FIG. 14 from the other side.
Figure 16:
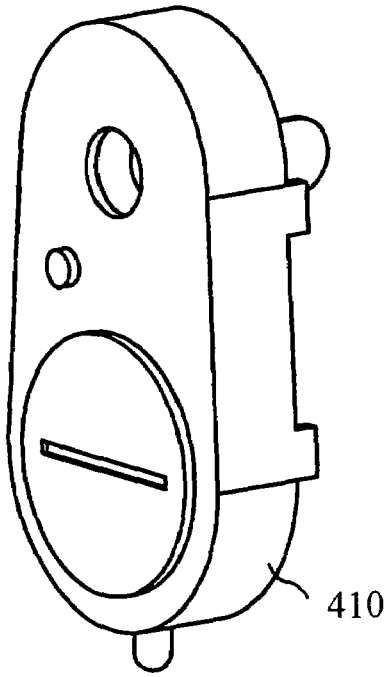
FIG. 16 is a perspective of the first detachable closure part of the closure means of FIG. 14.
Figure 17:
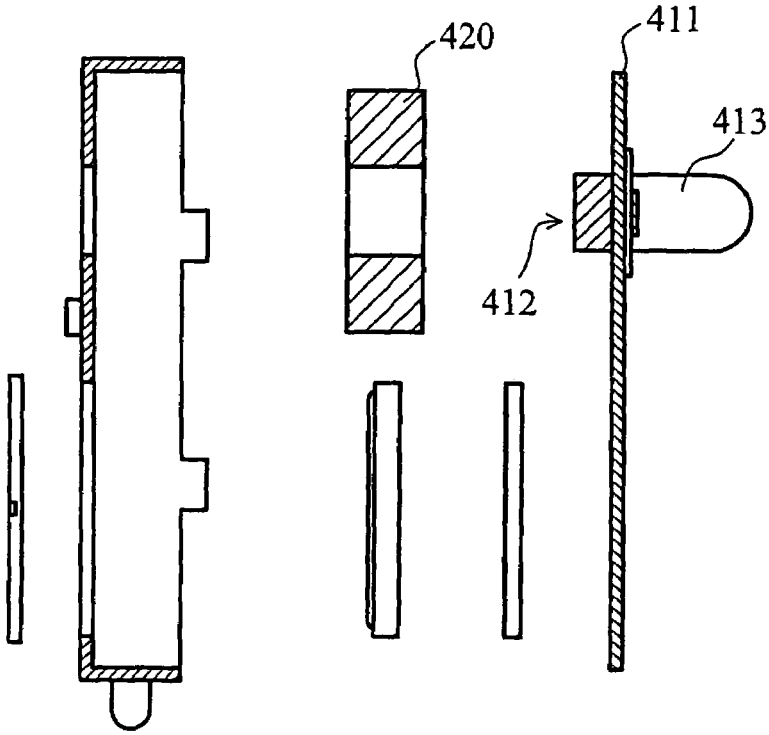
FIG. 17 is a cross-sectional view of the first detachable part of FIG. 16.
Figure 18:
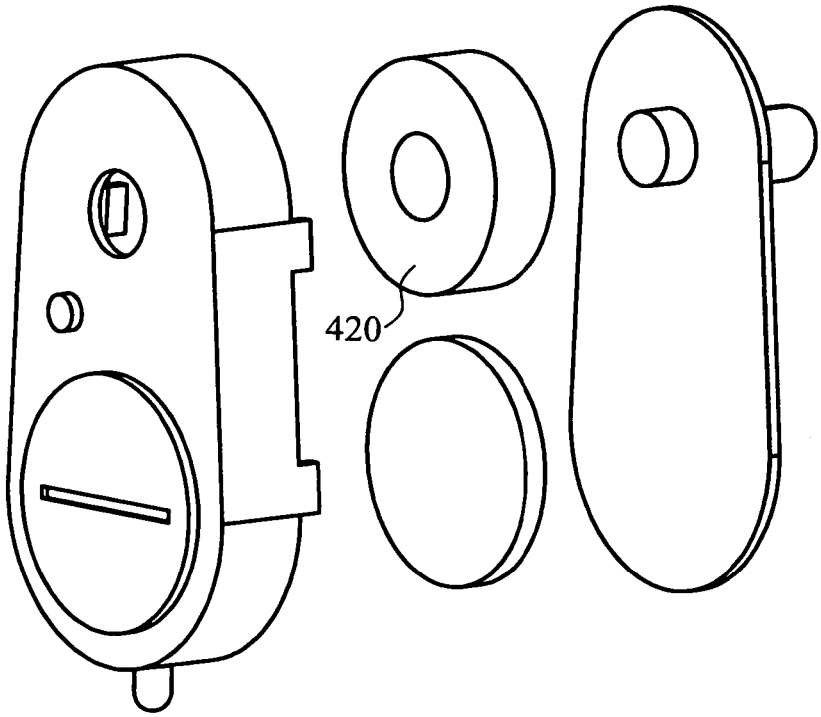
FIG. 18 is a partially exploded perspective view of the first detachable part of FIG. 16.
Figure 19:
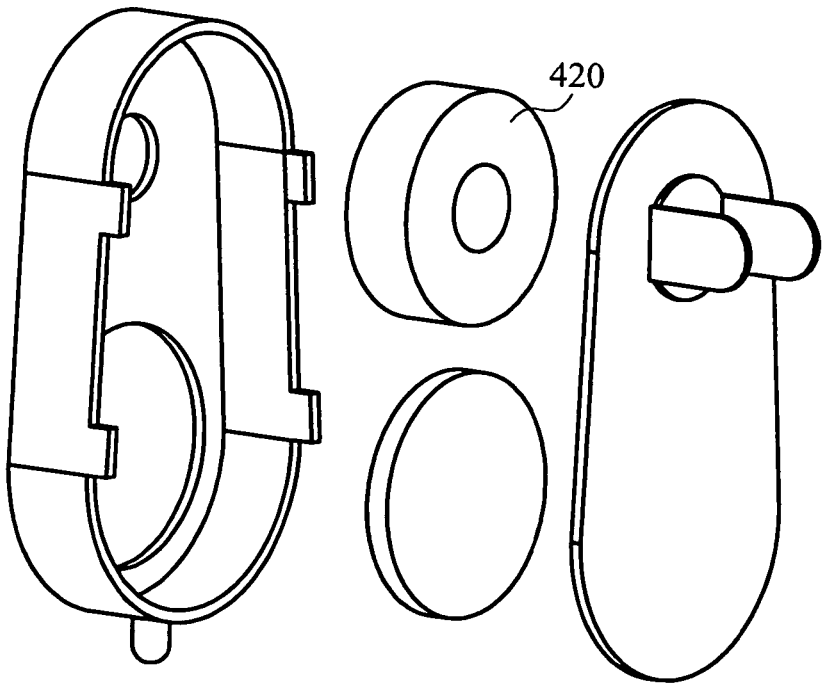
FIG. 19 is the partially exploded view of FIG. 18 from another side.
Figure 20:
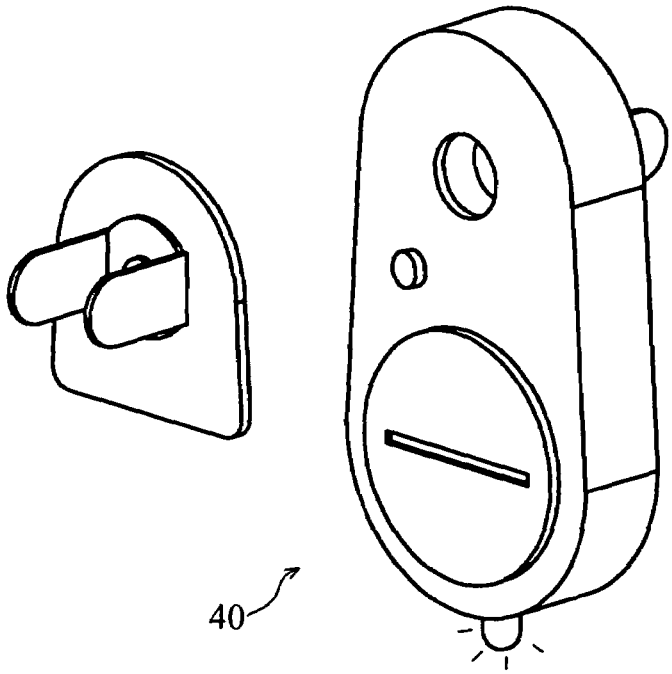
FIG. 20 shows the approaching of the first detachable closure parts of the closure means of FIG. 14 towards the second detachable closure part.
Figure 21:
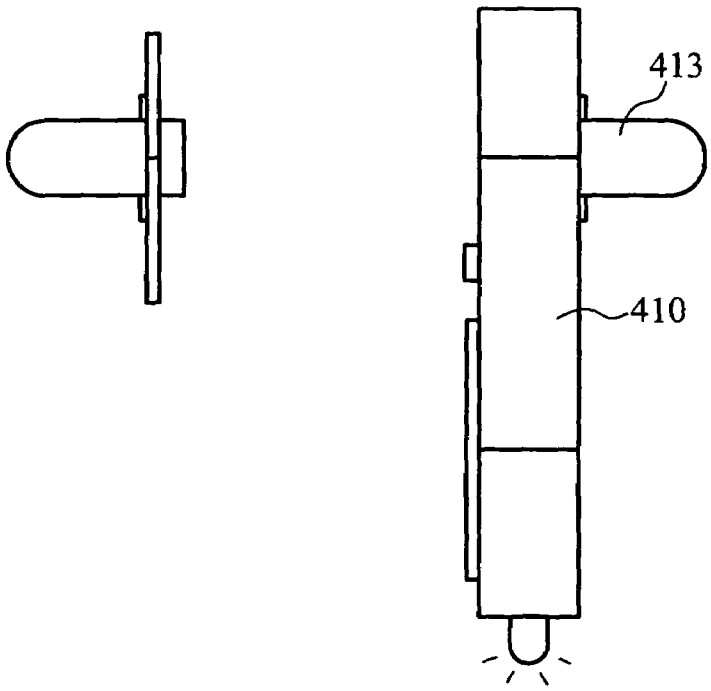
FIG. 21 is a side view of FIG. 20.

Referring to FIGS. 1–11, there is shown a first preferred embodiment of a magnetic closure and illumination means 10 of the present invention. The magnetic closure and illumination means 10 includes first and second detachable closure parts for attaching respectively to the corresponding closure parts of a carrying bag, as shown in FIGS. 12 and 13. The first 100 and the second 200 detachable closure parts include a pair of counterpart magnetic fasteners (first and second magnetic fasteners respectively) of compatible magnetic properties, for example, of opposite magnetic polarities, so that the first and the second detachable closure parts will be held in magnetic closing engagement by magnetic attractive force between the first and the second magnetic fasteners. By utilizing magnetic fasteners with guiding and aligning means, the pair of counterpart magnetic fasteners will come into closing engagement along a pre-determined path when the pair of magnetic fasteners are in mutual magnetic proximity. This self-guided and aligned closure features of the magnetic fasteners will bring the pair of detachable closure parts into closing engagement with enhanced user convenience and benefit.

One of the detachable closure parts (the first detachable closure part 100 in this example) includes, in addition to a magnetic fastener, a main housing 110 on which there are provided illumination means 120, an electronic circuit for controlling the operation of the illumination means, actuation means 130 for operation of the electronic circuit and the illumination means, and a battery compartment 140 containing a battery 141. The main housing can be integrally molded from plastics or stamp pressed from alloys or metallic sheets. A compartment for securely receiving the magnetic fastener (the first magnetic fastener 150 in this example) is also pre-formed so that the first magnetic fastener can be installed or mounted onto the main housing for subsequent mounting onto a carrying bag.

The first 150 and the second 250 magnetic fasteners include approaching surfaces which come into close contact or close proximity of each other when the first and the second detachable closure parts have come into a closing engagement. The actuation means is disposed on the main housing and adjacent the approaching or coupling surface of the first magnetic fastener so that when the second magnetic fastener comes into closing engagement with the first magnetic fastener, the actuation means will be actuated by the closing-in motion of the approaching surface of the second magnetic fastener.

In this example, the actuation means includes a push-button switch 131 which is disposed adjacent to the first magnetic fastener and within the footprint or projection of the approaching surface 260 of the second magnetic fastener. In particular, the push-button switch is disposed so that, when the second magnetic fastener is magnetically coupled with the first magnetic fastener, the push button will be pushed downwards towards the main housing and to turn off the illumination means. It will be note that, in this example, the approaching surface of the second magnetic fastener has a footprint exceeding that of the first magnetic fastener so as to provide an additional area to engage with the actuation push-button. Of course, the projection or footprint of the approaching surfaces of the first and second magnetic fasteners can be equal in which case the push-button or other actuation means will be disposed within the footprint of the approaching surfaces 160, 260 and intermediate the approaching contact surfaces so that it will be actuated or de-actuated upon magnetic engagement between the approaching surfaces.

As can be seen from the Figures, the first and the second magnetic fasteners will come into magnetic engagement or coupling along a first prescribed direction which is substantially parallel to the magnetic axis of the first and second magnetic fasteners and the push-button switch is retractable also along an a axis which is substantially parallel to the first prescribed direction.

In this example, the push-button switch 131 includes a spring-urged shank protruding from the front surface of the main housing (which is substantially parallel to the approaching contact surface of the first magnetic fastener), this spring urged shank will be pressed to retreat towards the main housing so as to cause the turning-off of the illumination means by using appropriate electrical connection or circuitry known to the skilled persons without loss of generality. Of course, more sophisticated electronic circuitry with timing or other purposive or utilitarian features can also be included in the circuitry. As can be seen from FIG. 6, the main housing includes "leg" apertures to allow the engaging legs of the first magnetic fastener to pass through and in order to engage with the closure part of the container or other articles on which the first detachable closure part is to be mounted.

The first magnetic fastener 150 includes a ring-magnet 151 with the front or approaching surface 152 embraced with a cover 153 of copper, aluminum, plastic or other appropriate magnetic permeable sheet materials to provide a preferred aesthetic appearance. The back side or non-approaching side of the ring-magnet is mounted with a back plate 154 made of an appropriate magnetic or ferro-magnetic material, such as stainless iron, so that the magnetic strength of the ring-magnet can be redirected through the central aperture of the ring-shaped magnet through a cylindrical head 155 or rivet protruding from the back plate towards the approaching surface of the first magnetic fastener. The magnetic body or head is a cylindrical piece also of magnetic or ferro-magnetic material connected to the back plate by, for example, riveting or stamping so that the magnetic strength emanating from the back side of the ring-magnet can be directed towards the approaching surface of the ring-magnet through the magnetic head protruding from the back plate towards the approaching surface of the first magnetic fastener. A mounting means, such as a pair of mounting legs 156 are also attached to the sub-assembly of the ring-magnet and the back plate by the riveted head or cylindrical magnetic body as more particularly shown in FIG. 10C.

Figure 1:
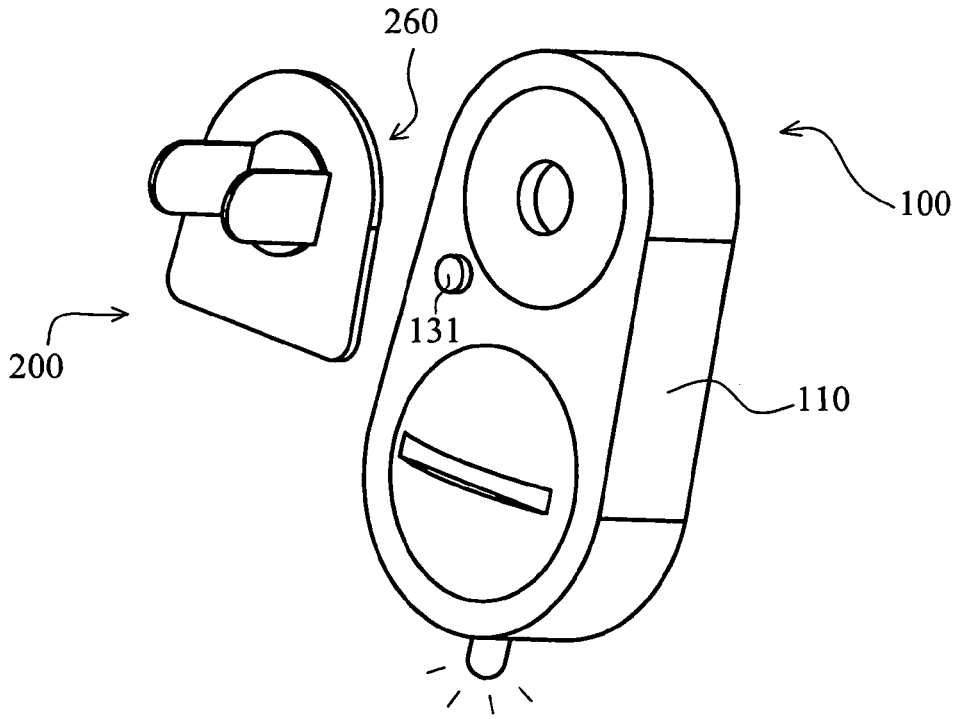
FIG. 1 is a perspective view showing first and second detachable closure parts of a magnetic closure means of a first preferred embodiment of the present invention.
Figure 2:
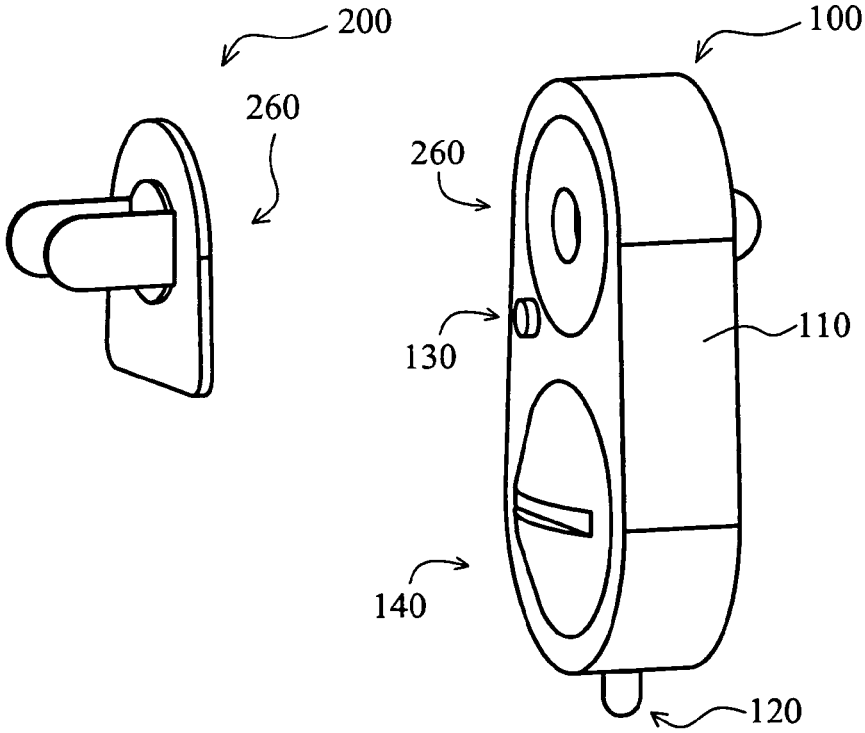
FIG. 2 is another perspective view showing the detachable closure parts of FIG. 1.
Figure 3:
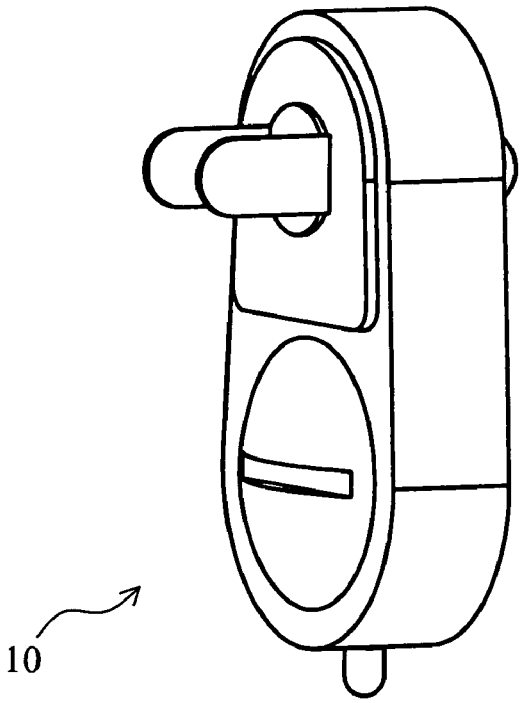
FIG. 3 is a perspective view from one side of the magnetic closure means when the detachable closure parts have come into closing engagement.
Figure 4:
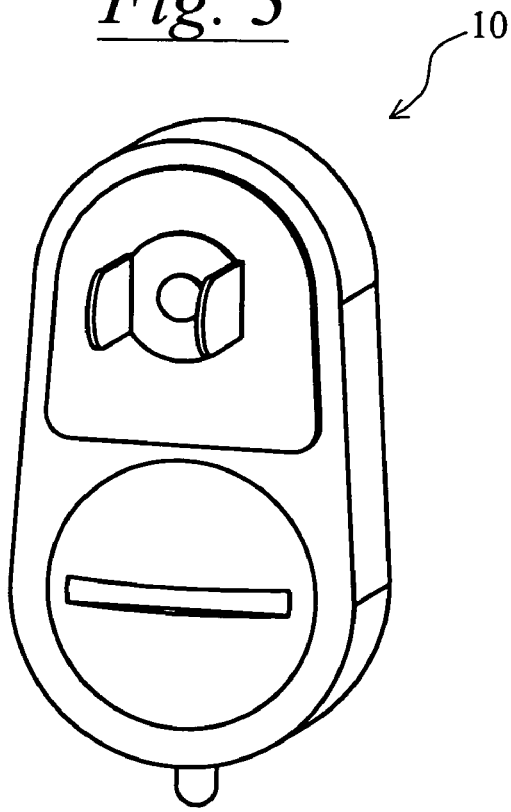
FIG. 4 is another perspective view of FIG. 3.
Figure 5:
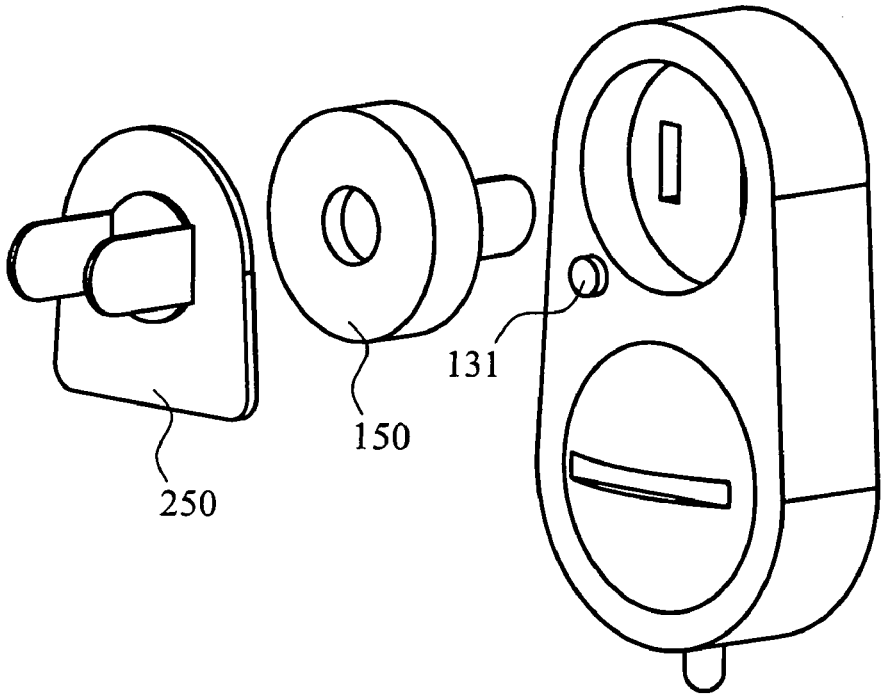
FIG. 5 is a perspective view showing one of the detachable closure parts in partly exploded form.
Figure 6:
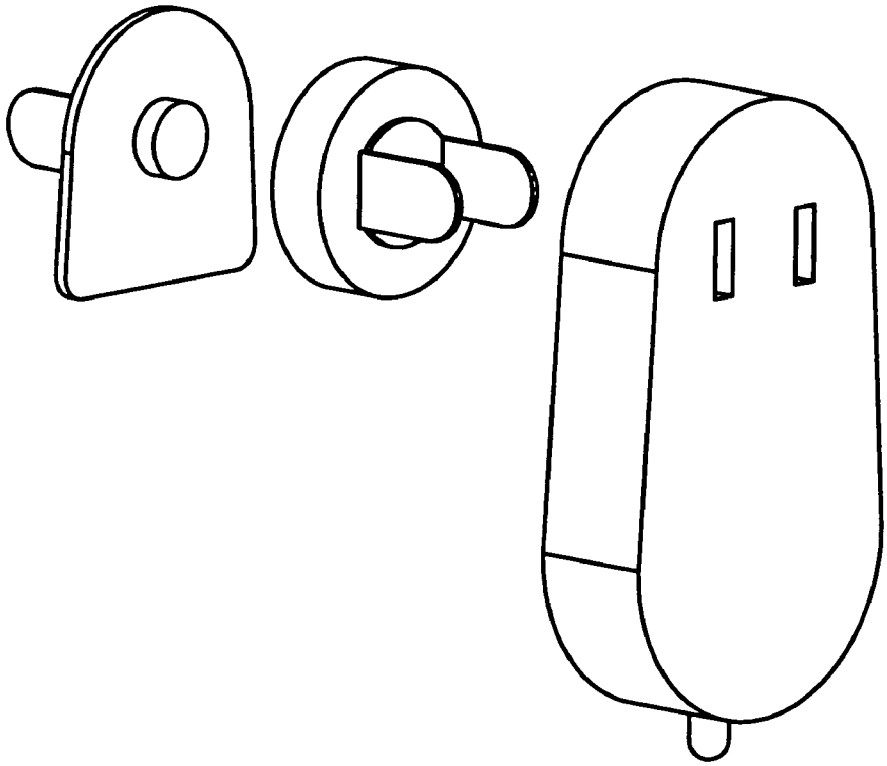
FIG. 6 is a perspective view of FIG. 5 from another side.
Figure 7:
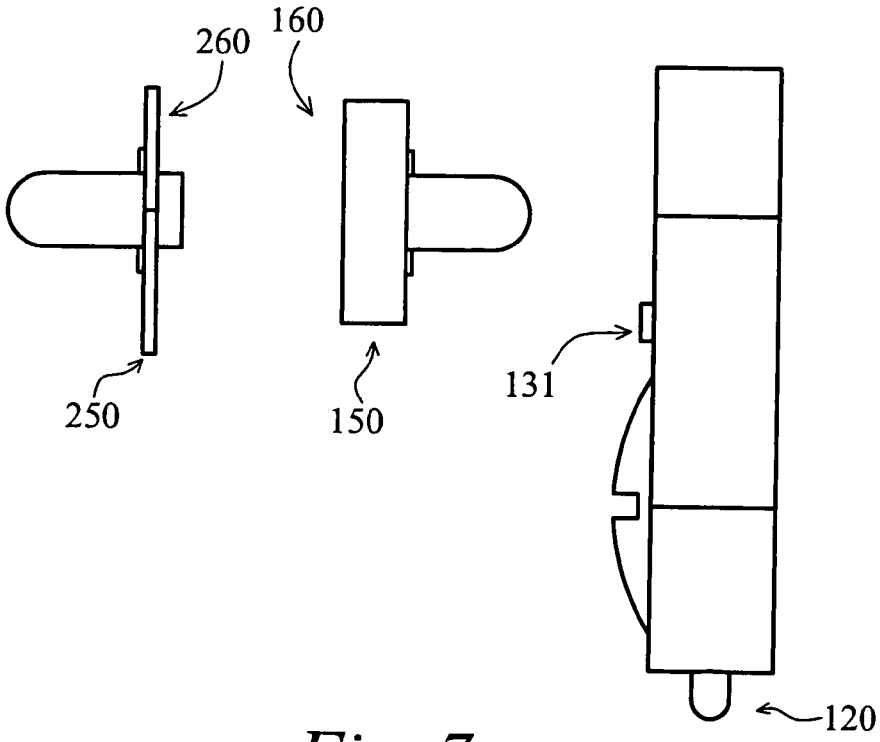
FIG. 7 is a side view of FIG. 5.
Figure 8:
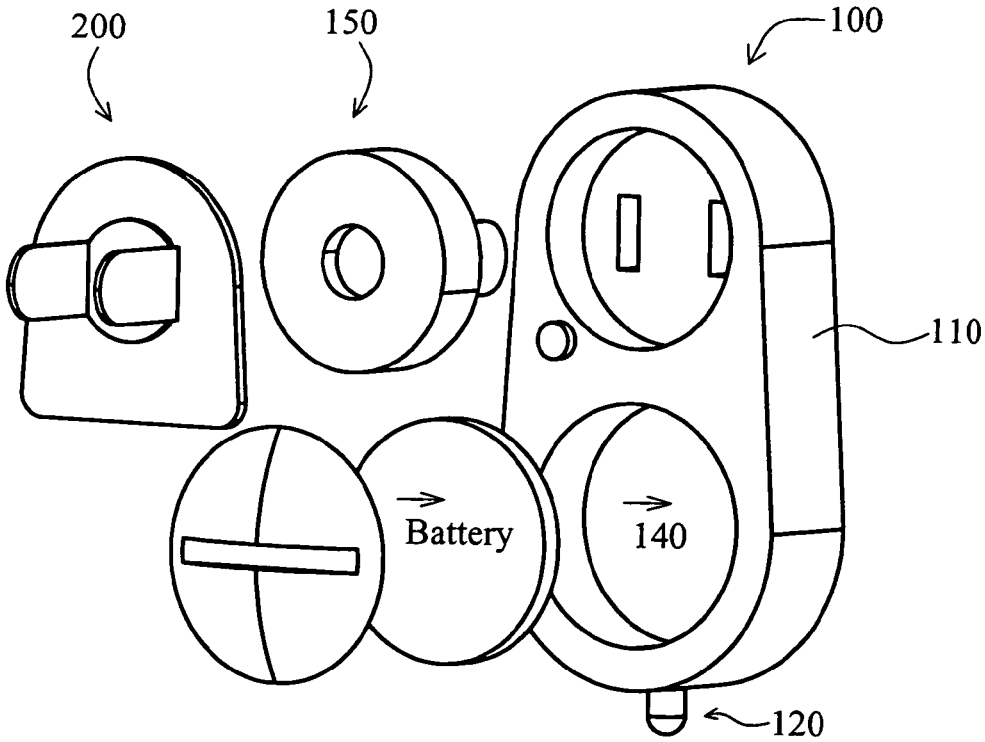
FIG. 8 is a more detailed partial exploded view of the closure means of FIG. 1, FIGS. 9A, 9B and 9C are respectively the front, side and bottom views of a second magnetic fastener of the second detachable closure part.
Figure 9A:
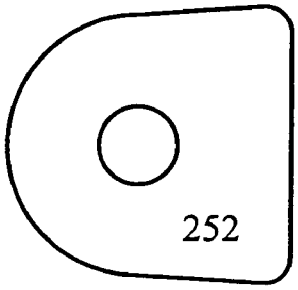
Figure 9B:
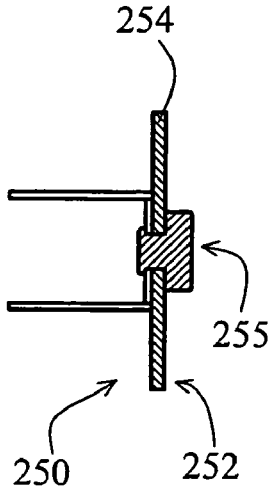
Figure 9C:
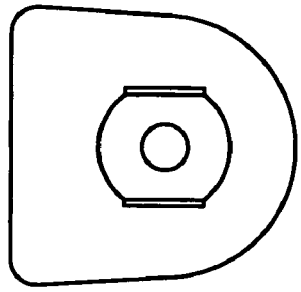
Figure 10A:
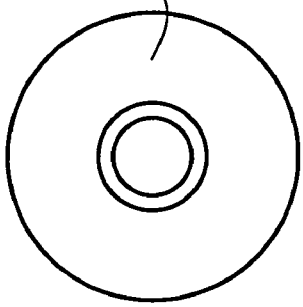
FIGS. 10A, 10B and 10C are respectively the front, side and bottom views of a first magnetic fastener of the first detachable closure part.
Figure 10B:
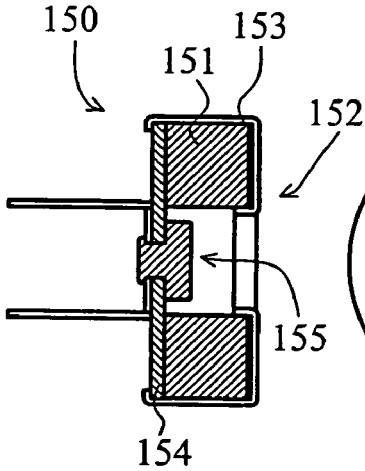
Figure 10C:
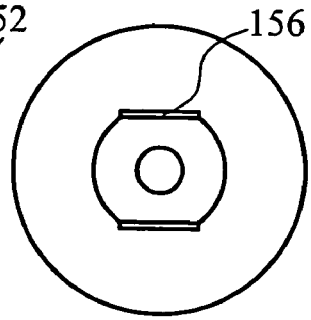
Figure 11:
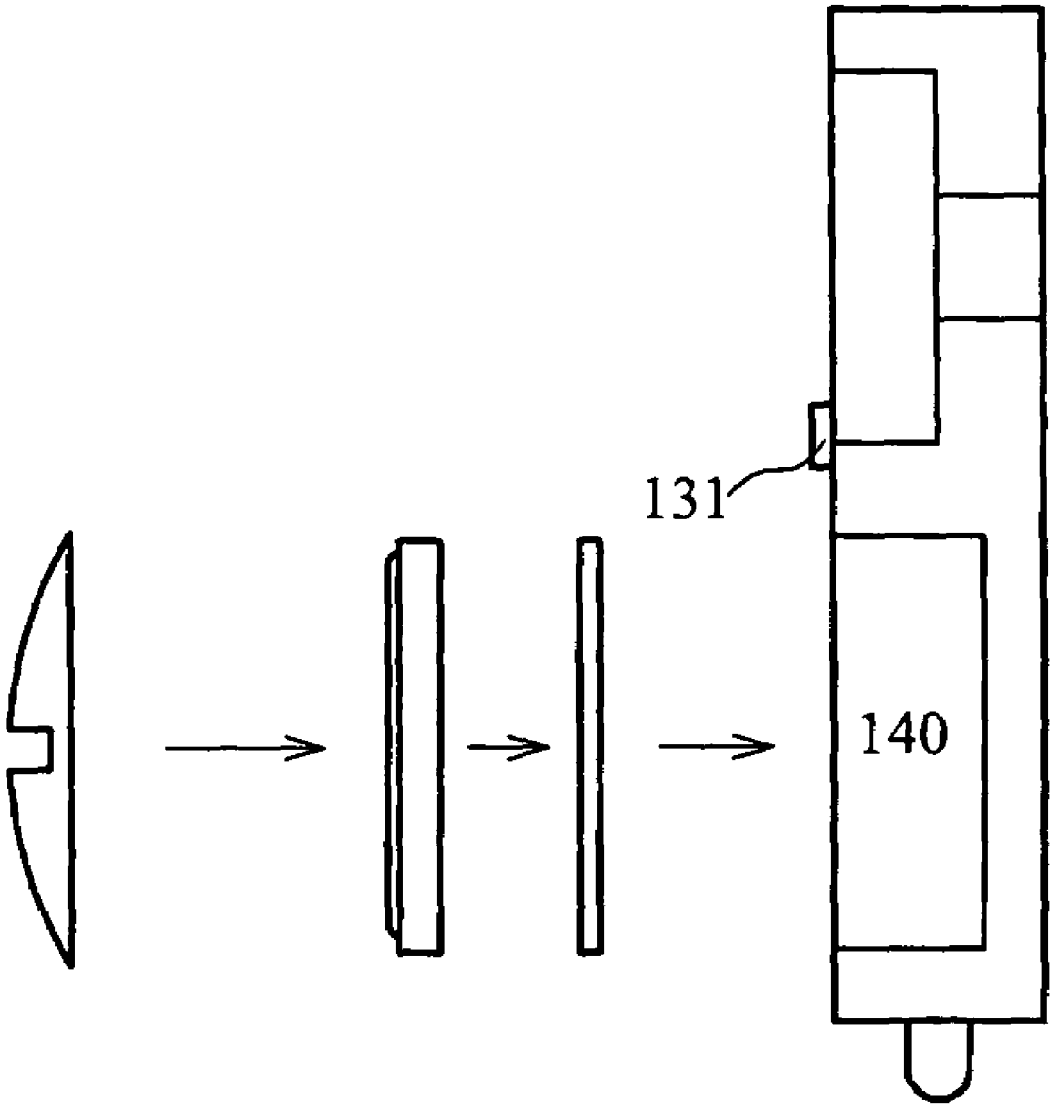
FIG. 11 is a longitudinal cross-sectional view of the main housing of one of the detachable closure parts.

Referring to FIGS. 9A to 9C, the second magnetic fastener 250 comprises a counterpart magnetic fastener with magnetic properties compatible with that of the first magnetic fastener 150 described above. Specifically, the second magnetic fastener comprises a ferro-magnetic base plate 254 and a protruding head 255 of magnetic properties compatible respectively to that of the approaching surface of the ring-magnet and the magnetic head of the first magnetic fastener. For example, if the approaching surface of the ring-magnet 151 and the magnetic head 155 of the first magnetic fastener are respectively of the "N" and "S" magnetic characteristics, ferro-magnetic base plate and protruding head can both be of non-magnetized in order to be magnetically compatible with the first magnetic fastener. Alternatively, the ferro-magnetic base plate 254 and protruding head 255 can be respectively of the "S" and "N" polarities to be compatible without loss of generality. It will be appreciated that the application of a ring-shaped magnet with a magnetic head protruding from the central aperture of the ring, so that the magnetic strength from the back or non-approaching side of the ring-shaped magnet can be utilized for added coupling strength will also enhance the self-guided and self-aligned coupling between the first and the second magnetic fasteners. Instead of a ring-magnet, a pellet-shaped magnet with a ferro-magnetic brace which surrounds the rim of the pellet magnet and redirects magnetic strength from the back side to the outer-rim of the pellet magnet, as described in U.S. Pat. No. 6,378,174, can be used.

The magnetic fasteners in this example include guiding and aligning means. The guiding and a ligning means is co-operatively formed between the protruding head of the second magnetic fastener and the partly retracted ferro-magnetic head in the central aperture of the ring-magnet. The appearance of the opposite magnetic polarities at the approaching surface further enhance the self-guiding and aligning.

Turning now to the operation of the magnetic closure means, when the first and the second detachable closure parts are in mutual proximity, the magnetic field in their proximity will cause the first and second detachable closure parts to move towards each other and towards a closing engagement as a result of the magnetic interaction between the first and second magnetic fasteners. Although the fasteners are referred to as magnetic fasteners, it will be appreciated that it is not essential to have magnets in both the first and the second magnetic fasteners since a magnet disposed in either one of the first and second magnetic fasteners will be sufficient to cause magnetic attraction to the other magnetic fastener, provided the other magnetic fastener includes a coupling or approaching surface made of an appropriate magnetic (or ferro-magnetic) material, such as iron or stainless iron without loss of generality.

The approaching surface 252 of the second magnetic fastener 250 is dimensioned with an appropriate footprint or projection so that when the first and the second magnetic fasteners have entered into closing engagement configuration, the push button will be pushed sufficiently deep by the approaching surface of the second magnetic fastener to cause turning-off of the illumination means, since the light is expected to be turned off when the handbag is closed.

On the other hand, when the first and the second magnetic fasteners are being separated, the spring urged push button switch will be gradually released by spring urge and will extend from the main housing of the first detachable closure part towards the second detachable closure part. When the push button has extended for a prescribed or sufficient distance from the main housing of the first magnetic fastener, the release of the push button switch will cause the turning-on of the illumination means by actuating the electronic control circuitry housed inside the main housing.

In this preferred embodiment, the illumination means 120 is a discrete LED with a focusing lens, a built-in reflector and a generally cylindrical body with the luminescent portion protruding from the side of the main housing. Specifically, the axis of the substantially cylindrical body is substantially orthogonal to the prescribed direction of relative movement between the first and the second magnetic fasteners or the magnetic axis of the ring-magnet of the first magnetic fastener. By having an LED protruding from the main housing of the first detachable closure part and along a substantially orthogonal axis from the magnetic axis, the LED will not hinder the closure of the respective re-closable parts and at the same time permitting a compact design in a substantially modular form so that the first and second detachable closure parts can be available as modules for convenient assembly without requiring complicated or clumsy wirings or distribution on the carrying bag. For example, as shown in FIG. 12, the first and second detachable closure parts can be mounted on corresponding positions on the closure parts of a portable container 20 without requiring ancillary wiring layout and an additional LED mounting, as was required in closure and illumination means of the conventional type. Likewise, FIG. 13 shows the application of the modular first and second detachable closure parts in a hand-carrying bag 30 in which the respective closure flaps of the carrying bags are mounted with the modular first and second detachable closure parts with the LED pointing towards the bottom of the carrying bag so that the direction of the light emanating from the LED is substantially orthogonal to the direction of closure as defined by the magnetic coupling direction of the first and second magnetic fasteners.

A second preferred embodiment of a magnetic closure means 40 of the present invention is shown in FIGS. 14–21.

In this preferred embodiment, instead of providing a compartment for mounting a discrete magnetic fastener, the main housing 410 includes a compartment with means for mounting a ring-shaped magnet 420 and a protruding head 412 penetrating the central aperture of the ring-shaped magnet to provide equivalent magnetic effect of that of the first magnetic fastener of the first preferred embodiment. In this application, the main housing 410 comprises a base plate 411 of a magnetic or ferro-magnetic material such as stainless iron to direct the magnetic flux from the back or non-approaching side of the ring-shaped magnet to appear inside the central aperture of the ring-shaped magnet. While the base plate is made of a ferro-magnetic material for this purpose, the top part of the main housing is made of a magnetic permeable material such as plastics, resins, copper, or polymers where appropriate. Similar to the first preferred embodiment, the protruding magnetic head 412 and the mounting legs 413 can be joined together to the back plate by riveting or other appropriate fastening means without loss of generality.

While the present invention has been explained by reference to the examples or preferred embodiments described above, it will be appreciated that those are examples to assist understanding of the present invention and are not meant to be restrictive. The scope of this invention should be determined and/or inferred from the preferred embodiments described above and with reference to the Figures where appropriate or when the context requires. In particular, variations or modifications which are obvious or trivial to persons skilled in the art, as well as improvements made thereon, should be considered as falling within the scope and boundary of the present invention.

Furthermore, while the present invention has been explained by reference to a carrying bag, it should be appreciated that the invention can apply, whether with or without modification, to other containers without loss of generality.

The invention claimed is:

1. Magnetic closure means, comprising:

a first detachable closure part comprising an illumination means, an electronic circuit for controlling the operation of said illumination means, an actuation means for operation of said electronic circuit and said illumination means, and a first magnetic fastener having a first approaching surface with an outer boundary;

a second detachable closure part comprising a second magnetic fastener having a second approaching surface which is capable of forming a magnetically engaged configuration with said first approaching surface;

wherein said actuation means is disposed adjacent to, but not within, said outer boundary of said first approaching surface of said first magnetic fastener and within the footprint of said second approaching surface; and wherein said actuation means is actuated by the separation between said first and second approaching surfaces.

2. The magnetic closure means according to claim 1, wherein said first and second magnetic fasteners comprise means for guiding and aligning the closure of said detachable closure parts substantially along a pre-determined path, and said actuation means is adapted to turn on said illumination means when the separation between said first and second detachable closure parts exceeds a pre-determined threshold.

3. The magnetic closure means according to claim 2, wherein said actuation means comprises co-operative actuation means for co-operatively actuating said illumination means when said first and second closure parts are separated beyond a prescribed separation.

4. The magnetic closure means according to claim 3, wherein said co-operative actuation means comprises a spring biased switching device which is pressed against spring bias to turn off said illumination means when said first and second detachable closure parts are in said magnetically engaged configuration, and said switching device is released by spring bias to turn on said illumination means when said first and second detachable closure parts are separated beyond said prescribed separation.

5. The magnetic closure means according to claim 4, wherein said first detachable closure part comprises a rigid main housing which includes a battery compartment and houses said first magnetic fastener and said electronic circuit, and said illumination means includes a luminescent portion protruding from said main housing.

6. The magnetic closure means according to claim 1, wherein said illumination means comprises an LED.

7. The magnetic closure means according to claim 1, wherein said first and second detachable closure parts comprise means for mounting on to corresponding closure parts of a carrying bag.

8. The magnetic closure means according to claim 1, wherein said first and second detachable closure parts are engagable and disengagable along a pre-determined path, said illumination means comprises an LED with a substantially cylindrical body, and the axis of said cylindrical body is substantially orthogonal to said pre-determined path.

9. The magnetic closure means according to claim 1, wherein said first and second approaching surfaces are in close proximity when said magnetic fasteners are in said magnetically engaged configuration, and said first and second approaching surfaces co-operate to cause the turning on and off of said illumination means.

10. The magnetic closure means according to claim 4, wherein said switching device comprises a spring biased push-button for turning on and off said illumination means, said push-button protrudes from said first approaching surface and extends towards said second approaching surface, and said push button is pushed by said second approaching surface to retract towards said first approaching surface to turn off said illumination means when said first and second closure parts come into closing engagement.

11. The magnetic closure means according to claim 1, wherein said first and second magnetic fasteners are of compatible magnetic attractive properties.

12. A carrying bag including magnetic closure means according to claim 1.

13. A carrying bag including magnetic closure means according to claim 2.

14. A carrying bag including magnetic closure means according to claim 3.

15. A carrying bag including magnetic closure means according to claim 4.

16. A carrying bag including magnetic closure means according to claim 5.

17. A carrying bag including magnetic closure means according to claim 6.

18. A carrying bag including magnetic closure means according to claim 7.

19. A carrying bag including magnetic closure means according to claim 8.

20. A carrying bag including magnetic closure means according to claim 9.

21. A carrying bag including magnetic closure means according to claim 10.

* * * * *